US008984918B2

(12) United States Patent
Kim et al.

(10) Patent No.: US 8,984,918 B2
(45) Date of Patent: Mar. 24, 2015

(54) WASHING MACHINE, INNER TUB OF WASHING MACHINE AND BALANCER CONNECTION AND ASSEMBLY METHOD THEREOF

(75) Inventors: Yong Kwon Kim, Daejeon-si (KR); Kyu Chai Lee, Hwaseong-si (KR); Hong Seok Ko, Yongin-si (KR); Sang Up Lee, Yongin-si (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 1015 days.

(21) Appl. No.: 12/805,861

(22) Filed: Aug. 20, 2010

(65) Prior Publication Data

US 2011/0041565 A1 Feb. 24, 2011

(30) Foreign Application Priority Data

Aug. 24, 2009 (KR) ..... 10-2009-0077946

(51) Int. Cl.
*D06F 37/22* (2006.01)
*D06F 31/00* (2006.01)

(52) U.S. Cl.
CPC ..... *D06F 37/225* (2013.01); *D06F 2222/00* (2013.01); *D06F 31/00* (2013.01)
USPC ..... 68/23.2; 68/142

(58) Field of Classification Search
CPC ..... D06F 37/225; D06F 31/00; D06F 37/22; D06F 2222/00
USPC ..... 68/23.1, 23.2, 24, 142; 74/572.4
See application file for complete search history.

(56) References Cited

U.S. PATENT DOCUMENTS

| | | | | |
|---|---|---|---|---|
| 2,984,094 | A * | 5/1961 | Belaieff | 68/23.2 |
| 4,044,626 | A * | 8/1977 | Hayashi et al. | 68/23.1 |
| 4,321,809 | A * | 3/1982 | Bochan | 68/207 |
| 5,761,932 | A * | 6/1998 | Kim | 68/23.2 |
| 5,802,885 | A * | 9/1998 | Kim | 68/23.2 |
| 5,806,349 | A * | 9/1998 | Kim et al. | 68/23.2 |
| 5,850,749 | A * | 12/1998 | Kim | 68/23.2 |
| 5,855,127 | A * | 1/1999 | Kohara et al. | 68/23.2 |
| 5,857,360 | A * | 1/1999 | Kim et al. | 68/23.2 |
| 5,857,361 | A * | 1/1999 | Jang | 68/23.2 |
| 5,916,274 | A * | 6/1999 | Lee et al. | 68/23.2 |
| 6,205,603 | B1 * | 3/2001 | Vande Haar | 8/159 |
| 6,442,782 | B1 * | 9/2002 | Vande Haar | 8/159 |

(Continued)

FOREIGN PATENT DOCUMENTS

| | | |
|---|---|---|
| CN | 1171464 A | 1/1998 |
| KR | 10-0244204 | 11/1999 |

(Continued)

OTHER PUBLICATIONS

Chinese Office Action mailed Dec. 3, 2013 in corresponding Chinese Application No. 201010260990.4

*Primary Examiner* — Joseph L Perrin
(74) *Attorney, Agent, or Firm* — Staas & Halsey LLP

(57) ABSTRACT

Disclosed herein is a washing machine in which a balancer is directly mounted on a body of an inner tub without a front surface part of the inner tub. The washing machine includes an outer tub to store water, a body formed in a cylindrical shape provided with an opening at one surface thereof and provided in the outer tub, and a balancer connected to an inner diameter part at the opening of the body to reduce unbalance of the body generated during rotation of the body and to reinforce the body.

11 Claims, 7 Drawing Sheets

(56) References Cited

U.S. PATENT DOCUMENTS

| | | | | |
|---|---|---|---|---|
| 6,550,292 | B1 * | 4/2003 | Southworth et al. | 68/23.2 |
| 6,658,902 | B2 * | 12/2003 | Southworth et al. | 68/23.2 |
| 2004/0194514 | A1 * | 10/2004 | No et al. | 68/24 |
| 2005/0028564 | A1 * | 2/2005 | Lee et al. | 68/24 |
| 2007/0119216 | A1 * | 5/2007 | Jeong et al. | 68/3 R |
| 2007/0157677 | A1 * | 7/2007 | Tatsumi et al. | 68/142 |
| 2007/0277560 | A1 * | 12/2007 | Kim et al. | 68/23.1 |
| 2007/0277561 | A1 * | 12/2007 | Ryu et al. | 68/23.1 |

FOREIGN PATENT DOCUMENTS

| | | |
|---|---|---|
| KR | 10-2007-0115300 | 12/2007 |
| KR | 10-2008-0026887 | 3/2008 |

* cited by examiner

WASHING MACHINE, INNER TUB OF WASHING MACHINE AND BALANCER CONNECTION AND ASSEMBLY METHOD THEREOF

CROSS-REFERENCE TO RELATED APPLICATIONS

This application claims the benefit of Korean Patent Application No. 2009-0077946, filed on Aug. 24, 2009 in the Korean Intellectual Property Office, the disclosure of which is incorporated herein by reference.

BACKGROUND

1. Field

Embodiments relate to a washing machine with a balancer to reduce unbalance of an inner tub and noise generation.

2. Description of the Related Art

In general, a washing machine rotates an inner tub containing laundry using a driving motor, thus washing the laundry. The inner tub is rotated at a low speed in regular and reverse directions during a washing operation, and is rotated at a high speed in any one direction during a spin-drying operation.

The inner tub includes a cylindrical drum provided with opened front and rear surfaces, a ring-shaped front surface part maintaining rigidity of the drum and forming an inlet through which the laundry is put into and taken out of the inner tub, and connected to the front surface of the drum through a curling process, and a circular rear surface part closing the opened rear surface of the drum.

Further, a balancer to reduce unbalance of the inner tub and noise generation due to mismatch between the center of gravity and the center of rotation of the inner tub is mounted on the outer surface of the front surface part.

In the conventional washing machine, the front surface part made of metal is connected to the front surface of the cylindrical drum made of metal and then the balancer is mounted on the outer surface of the front surface part, thereby complicating a manufacturing process and increasing manufacturing costs of the inner tub.

Further, the front surface part is generally formed by processing a stainless steel material using a separate mold set, thereby increasing the manufacturing costs of the inner tub.

Moreover, the conventional balancer mounted on the outer circumferential surface of the front surface part serves to remove partial disposition of mass of the laundry and thus to reduce the unbalance of the inner tub, but this structure of the balancer does not directly affect improvement of washing performance.

SUMMARY

Therefore, it is an aspect of at least one embodiment to provide a washing machine in which a balancer is directly mounted on a body of an inner tub without a front surface part of the inner tub.

It is another aspect of at least one embodiment to provide a washing machine which improves an assembly process of an inner tub and a balancer.

It is another aspect of at least one embodiment to provide a washing machine provided with a balancer which prevents deformation of an inner tub.

It is a further aspect of at least one embodiment to provide a washing machine provided with a balancer which improves washing performance.

Additional aspects will be set forth in part in the description which follows and, in part, will be obvious from the description, or may be learned by practice of the invention.

The foregoing and/or other aspects are achieved by providing a washing machine including an outer tub to store water, a body formed in a cylindrical shape provided with an opening at one surface thereof, and provided in the outer tub, and a balancer connected to an inner diameter part at the opening of the body to reduce unbalance of the body generated during rotation of the body and to reinforce the body.

The balancer may be mounted to contact laundry in the body.

A designated region of the body at the opening may have a diameter which is regular in the axial direction of the body.

The balancer may include an inner diameter part forming an inlet through which laundry is put into the body, and an outer diameter part contacting the inner diameter part of the body.

The washing machine may further include a cover to close a designated front region of the outer tub, and the balancer may further include a protrusion protruded toward the cover to guide the laundry into and out of the body.

A fastening guide into which a front end of the body at the opening may be inserted is provided on the outer diameter part of the balancer.

The balancer may further include at least one blade generating a water current during the rotation of the body.

The at least one blade may be provided in plural number and formed in the radial direction from the center of the balancer.

The balancer may be a ball balancer including a plurality of balls and a fluid provided therein.

The washing machine may further include at least one first blade provided on the inner diameter part of the body, and at least one second blade provided on the balancer.

The washing machine may further include a pair of washing units vertically stacked, and the balancer may be provided on the upper washing unit among the pair of washing units.

The body may include a first plurality of screw holes defined therethrough, and the balancer may include a second plurality of screw holes defined therethrough corresponding to the first screw holes, the balancer being screw-connected to the body by the first and second screw holes.

The foregoing and/or other aspects are achieved by providing an inner tub of a washing machine, which is rotatably provided in an outer tub to contain laundry and thus to perform washing of the laundry, includes a cylindrical body provided with an opening at one surface thereof, and a balancer including a balancer housing forming a ring-shaped flow space therein, and mass bodies moving within the flow space, if unbalance of the body due to laundry occurs during rotation of the body, to a position opposite to the laundry, wherein the balancer housing is connected directly to an inner diameter part of the body.

The body may have a diameter which is regular or is linearly increased or decreased in the axial direction of the body.

A protrusion extended in the axial direction may be formed on the balancer housing.

The balancer may further include at least one blade formed on a surface facing an inside of the cylindrical body.

The balancer housing may form an inlet through which the laundry is put into and taken out of the body.

A fastening guide connected with a front end of the body may be provided on the balancer housing.

The balancer may be a ball balancer including a plurality of balls and a fluid provided in the flow space.

The at least one blade may be formed opposite to the protrusion.

The foregoing and/or other aspects are achieved by providing an assembly method of an inner tub of a washing machine, which is rotatably provided in an outer tub to contain laundry and thus to perform washing of the laundry, includes cutting a metal plate to a designated size, forming through holes on the metal plate cut to the designated size, forming a cylindrical body using the metal plate cut to the designated size, and preparing a balancer to reduce unbalance of the cylindrical body, and connecting the balancer directly to the cylindrical body to enable an inner diameter part of the balancer to form an inlet of the cylindrical body.

The connection of the balancer to the cylindrical body may be achieved by contact of an outer diameter part of the balancer with an inner diameter part of a front end of the cylindrical body.

The assembly method may further include connecting a rear surface plate to close a rear surface of the cylindrical body to the cylindrical body before or after the connection of the balancer to the cylindrical body.

The foregoing and/or other aspects are achieved by providing an inner tub of a washing machine, which is rotatably provided in an outer tub to contain laundry and to perform washing of the laundry, the inner tub including: a cylindrical body provided with an opening at one surface thereof; and a balancer including a balancer housing forming a ring-shaped flow space at an outer circumferential portion thereof and configured to receive a plurality of balls therein movable within the flow space, an outer diameter part of the balancer housing being connected directly to an inner diameter part of the body.

The inner tub may further include at least one blade extending from the balancer housing at a surface of the balancer housing facing toward an inside of the cylindrical body.

BRIEF DESCRIPTION OF THE DRAWINGS

These and/or other aspects will become apparent and more readily appreciated from the following description of the embodiments, taken in conjunction with the accompanying drawings of which.

DETAILED DESCRIPTION

Figure 1:
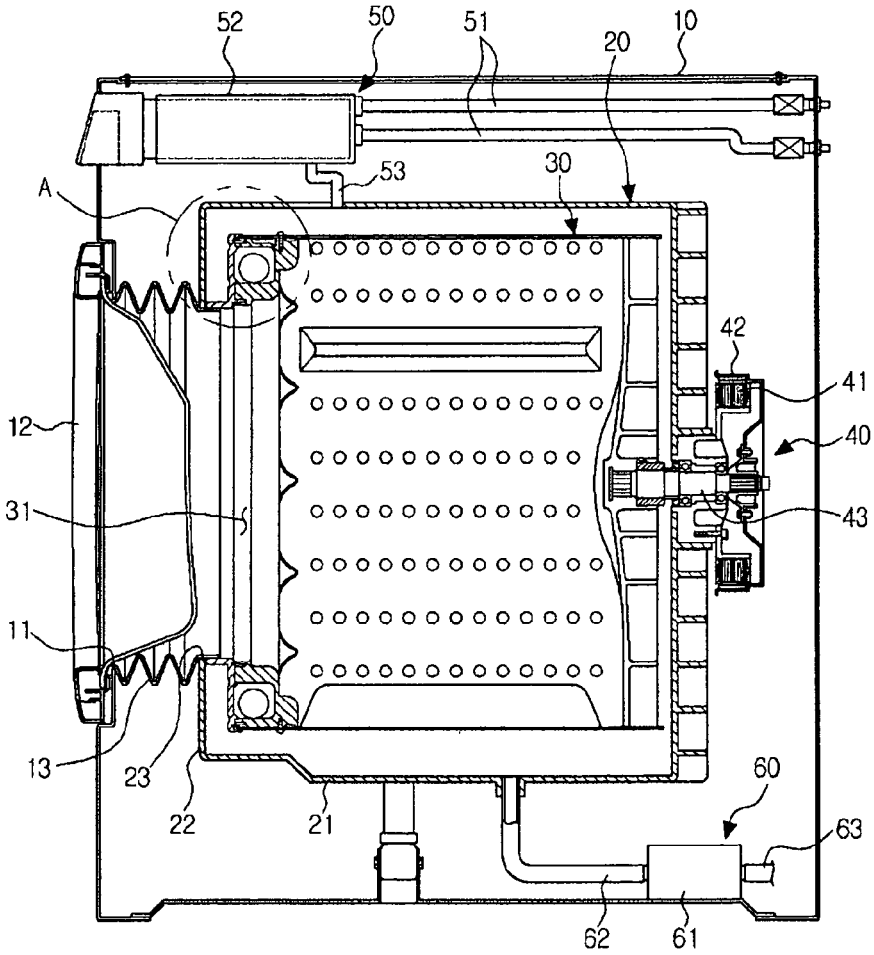
FIG. 1 is a longitudinal-sectional view schematically illustrating a washing machine in accordance with at least one embodiment.

Reference will now be made in detail to the at least one embodiment, examples of which are illustrated in the accompanying drawings, wherein like reference numerals refer to like elements throughout.

Figure 2:
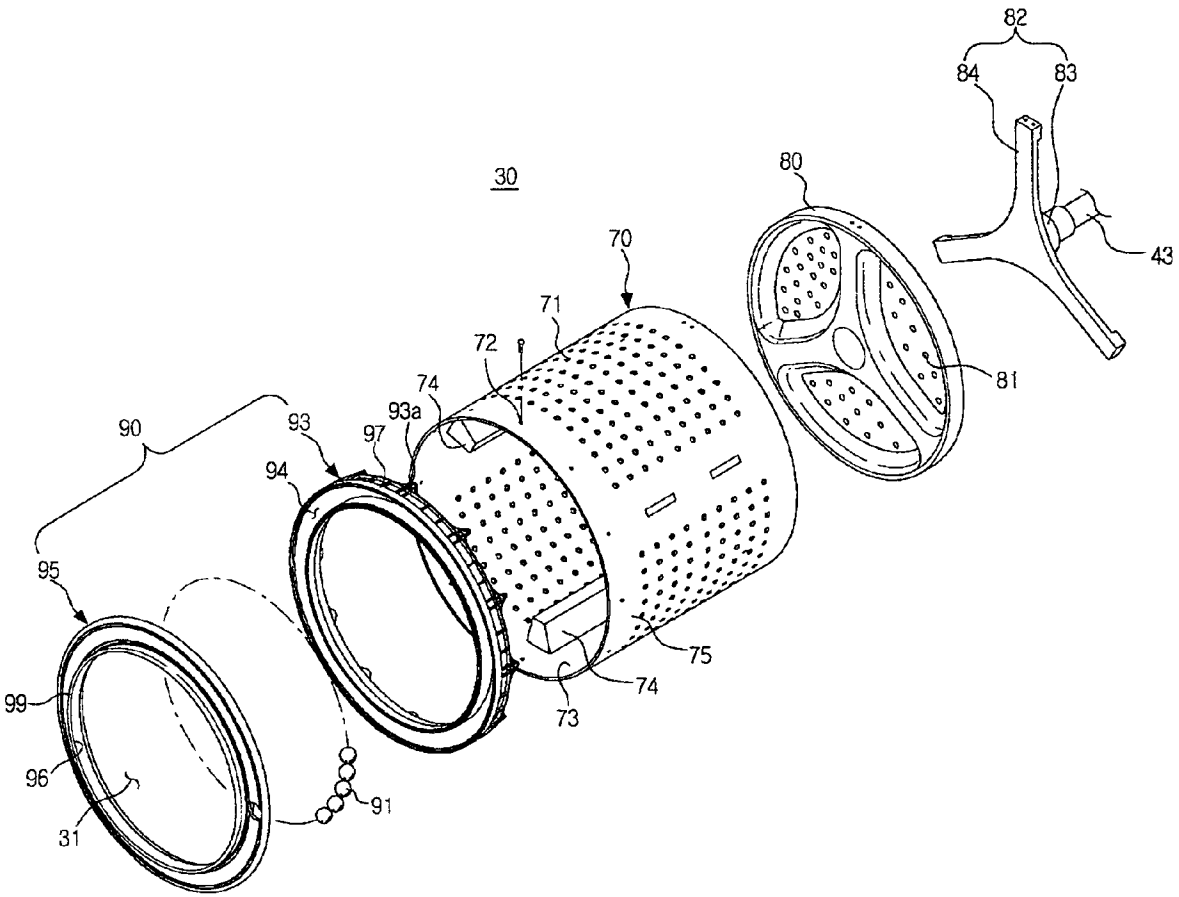
FIG. 2 is an exploded perspective of an inner tub of the washing machine in accordance with at least one embodiment.
Figure 3:
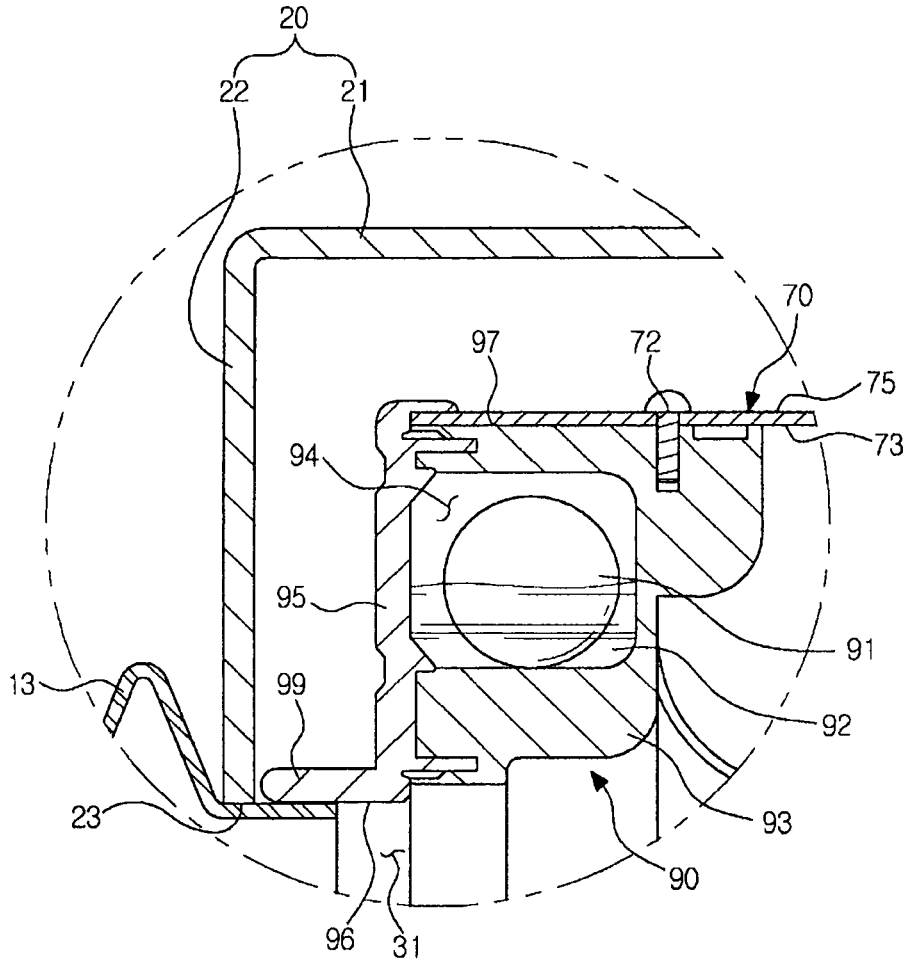
FIG. 3 is an enlarged view of a portion A of FIG. 1.
Figure 4:
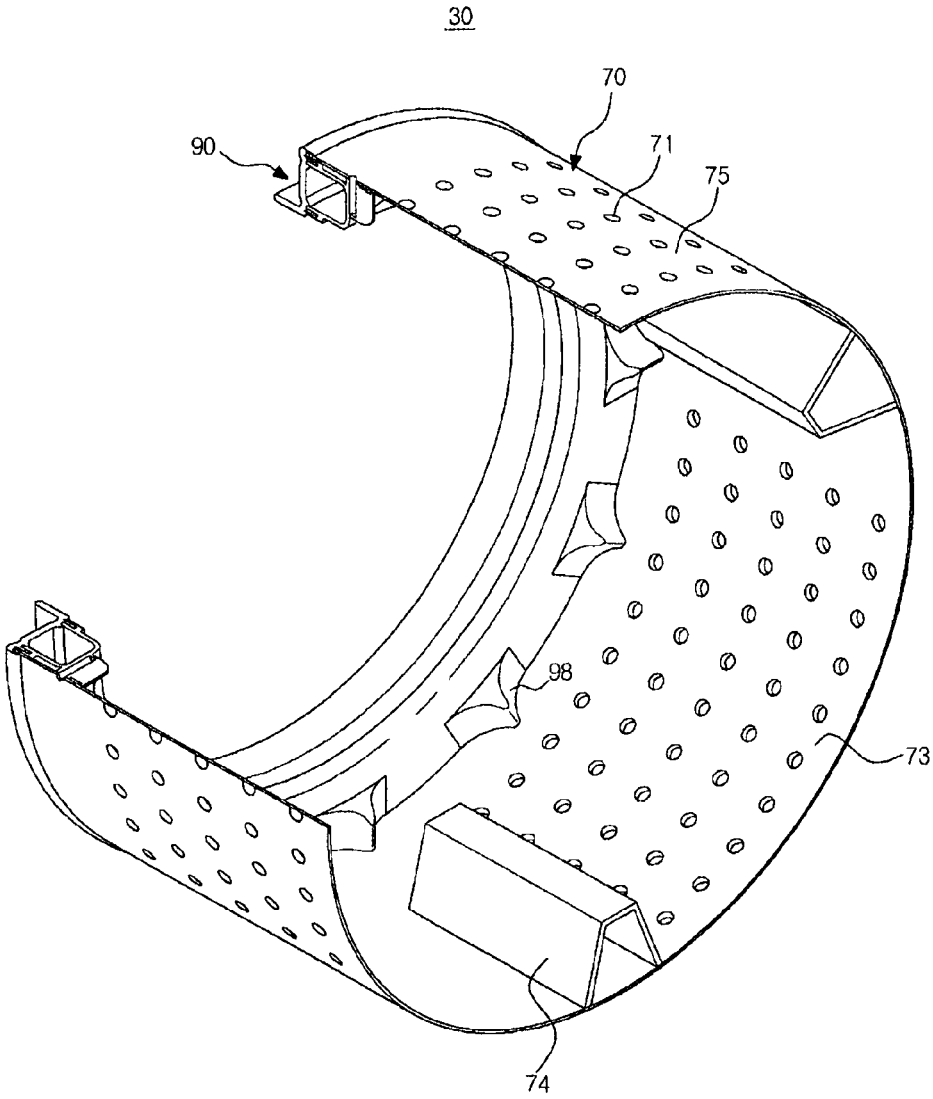
FIG. 4 is a perspective view of the inner tub, which is partially cut out, of the washing machine in accordance with at least one embodiment.
Figure 5:
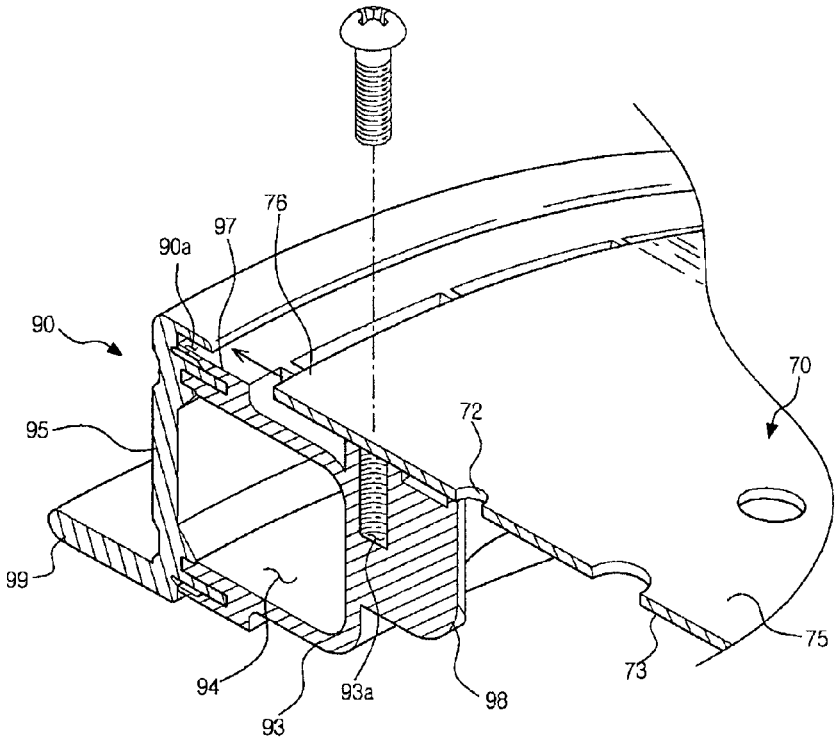
FIG. 5 is a view illustrating a connection process of a body of the inner tub and a balancer in accordance with at least one embodiment.

FIG. 1 is a longitudinal-sectional view schematically illustrating a washing machine in accordance with at least one embodiment, FIG. 2 is an exploded perspective of an inner tub of the washing machine in accordance with at least one embodiment, FIG. 3 is an enlarged view of a portion A of FIG. 1, FIG. 4 is a perspective view of the inner tub, which is partially cut out, of the washing machine in accordance with at least one embodiment, and FIG. 5 is a view illustrating a connection process of a body of the inner tub and a balancer in accordance with at least one embodiment.

The washing machine in accordance with at least one embodiment includes a housing 10 provided in the shape of a box to form an external appearance of the washing machine, an outer tub 20 provided in the housing 10 to contain water, an inner tub 30 rotatably installed in the outer tub 20, a driving motor 40 transmitting rotary force to the inner tub 30 to rotate the inner tub 30 such that laundry contained in the inner tub 30 is washed and spin-dried, a water supply device 50 to supply detergent and water to the inside of the outer tub 20, and a drain device 60 to discharge water in the outer tub 20 to the outside of the housing 10.

The outer tub 20 includes a cylindrical part 21 provided with an opening formed at one surface thereof, and a cover 22 through which an inlet 23 is defined, and through which the laundry is put into and taken out of the outer tub 20, at the opening of the cylindrical part 21, the cover 22 closing the remaining regions of the opening of the cylindrical part 21.

Although this embodiment illustrates that the cylindrical part 21 and the cover 22 are integrally formed, the cylindrical part 21 and the cover 22 may be separately manufactured and then connected through welding or any other type of connecting method.

The driving motor 40 to rotate the inner tub 30 is installed at the outside of the rear surface of the outer tub 20. The driving motor 40 includes a stator 41 fixed to the rear surface of the outer tub 20, a rotor 42 rotatably arranged at the periphery of the stator 41, and a rotary shaft 43 provided with one end installed at the rotor 42 and the other end passing through the outer tub 20 and installed at the rear surface of the inner tub 30.

An opening 11 is formed through the front surface of the housing 10 at a position corresponding to the inlet 23 of the outer tub 20 and an inlet 31 of the inner tub 30 such that laundry is put into or taken out of the inside of the inner tub 30 through the opening 11. A door 12 rotated to open and close the opening 11 is hinged to the front surface of the housing 10.

A bellows 13 to prevent leakage of wash water is installed between the opening 11 of the housing 10 and the inlet 23 of the outer tub 20.

The water supply device 50 includes first water supply hoses 51 provided in an upper region of the inside of the housing 10 to receive wash water supplied from an external water source, a detergent container 52 to mix detergent with the wash water and to transmit the wash water containing the detergent to the outer tub 20, and a second water supply hose 53 to guide the wash water containing the detergent to the outer tub 20.

The drain device 60 includes a drain pump 61 provided in a lower region of the inside of the housing 10 to drain the wash water in the outer tub 20, and drain hoses 62 and 63 connected to the drain pump 61 to guide the wash water to the outside of the housing 10.

Although this embodiment illustrates only the basic configuration of the washing machine, the washing machine may further include other devices to perform additional functions, such as a drying device.

The inner tub 30, as shown in FIG. 2, includes a cylindrical body 70, the inside of which is hollow, a rear surface plate 80 connected to the rear part of the body 70 to close a rear surface of the body 70, and a balancer 90 connected to the front part of the body 70 opposite to the rear surface plate 80 to reduce unbalance of the body 70 and prevent deformation of the body 70 during rotation of the body 70.

The cylindrical body 70 has a diameter which is substantially regular in the axial direction or is linearly increased or decreased. A plurality of through holes 71 connecting the inside of the body 70 and the outside of the body 70 is formed through the body 70, and thus water supplied to the inside of the washing machine freely moves between the outer tub 20 and the inner tub 30.

A plurality of screw holes 72 for connection with the balancer 90 by screws, which is separated from each other by a designated interval, is formed through the front part of the body 70 along the circumferential surface of the body 70. However, the balancer 90 may be connected with the body 70 through any type of connection mechanism and is not limited to the screw hole and screw connection.

At least one first blade 74 separated from other blades by a designated interval is arranged in the axial direction on an inner diameter part 73 of the body 70. As the inner tub 30 is rotated in the regular and reverse directions, the first blade 74 lifts the laundry and then drops the laundry to wash the laundry.

For example, three or more first blades 74 are provided, and are arranged at a regular angle on the inner diameter part 73 of the body 70. If necessary, various numbers of the first blades 74 may be provided and arranged at various angles.

The rear surface plate 80 closes the rear surface of the body 70, and through holes 81 having the same shape as the through holes 71 of the body 70 are formed through the rear surface plate 80. Here, the size of the through holes 81 of the rear surface plate 80 may be equal to or differ from that of the through holes 71 of the body 70 according to design.

A shaft flange 82 to distribute the rotary force generated from the driving motor 40 throughout the inner tub 30 is fixed to the rear surface plate 80, and a rotary shaft 43 is fixed to the center of the shaft flange 82. Thereby, the inner tub 30 is rotated by the rotary force transmitted from the driving motor 40 through the shaft flange 82.

The shaft flange 82 distributes the rotary force generated from the driving motor 40 throughout several portions of the inner tub 30, thereby preventing excessive force from being applied to a specific portion of the inner tub 30. A front end of the rotary shaft 43 is fixed to the center of the shaft flange 82 and an outer circumferential end of the inner tub 30 is fixed to an outer end of the shaft flange 82, and thus the rotary force transmitted from the driving motor 40 through the rotary shaft 43 is distributed to the outer circumferential end of the inner tub 30.

The shaft flange 82 includes a hub part 83 to which the rotary shaft 43 is fixed, and a plurality of arm parts 84 extended from the hub part 83 in the centrifugal direction, fixed to the outer circumferential end of the inner tub 30, and separated from each other by a designated interval in the circumferential direction. In this embodiment, three arm parts 84 are provided on the shaft flange 82, and the rotary force transmitted from the driving motor 40 through the rotary shaft 43 is distributed to three points of the outer circumferential end of the inner tub 30 through the three arm parts 84.

Although this embodiment illustrates a direct drive motor as a device to rotate the inner tub 30, a motor (not shown) fixed at the outside of the outer tub 20 and a driving belt (not shown) to transmit driving force of the motor to the rotary shaft 43 may be used.

The balancer 90 is installed on the front surface of the body 70 opposite to the rear surface plate 80. The balancer 90 rapidly reduces unbalance of the inner tub 30 generated due to partial disposition of mass caused by the weight of the laundry in the inner tub 30 according to rotation of the inner tub 30, thereby stabilizing the rotation of the inner tub 30 at an early stage.

The balancer 90 is ring-shaped, and is installed on the inner tub 30 concentrically with the center or rotation of the inner tub 30. As shown in FIGS. 2 and 3, the balancer 90 includes a plurality of balls 91 formed in the shape of a sphere and serving as mass bodies having a balancing function, a balancer housing 93 to receive the plurality of balls 91 and guide rotation of the plurality of balls 91, a housing cover 95 connected to the balancer housing 93 to form a race 94 in which the plurality of balls 91 move, and a viscous fluid 92 injected into the race 94 to adjust a moving velocity of the plurality of balls 91.

Therefore, when partial disposition of mass in the inner tub 30 due to the weight of the laundry occurs, the balls 91 move to a position that is symmetrical with the position where partial disposition of mass in the inner tub 30 occurs, along the race 94, thereby coping with the partial disposition of mass in the inner tub 30 and thus rapidly reducing unbalance of the inner tub 30 generated due to the partial disposition of mass in the inner tub 30.

The balancer housing 93 and the housing cover 95 are injection molded products, for example, having a designated thickness to satisfy a required strength of the balancer 90.

In order to reinforce the body 70 and form the inlet 31 of the inner tub 30, the balancer 90 is connected directly to the inner diameter part 73 at the front end of the body 70.

That is, the balancer 90 is connected to the body 70 under the condition that an outer diameter part 97 of the balancer 90 contacts the inner diameter part 73 of the body 70 at the front end of the body 70, and a space formed by an inner diameter part 96 of the balancer 90 becomes the inlet 31 through which the laundry is put into and taken out of the body 70.

A plurality of screw holes 93*a* corresponding to the screw holes 72 of the body 70 is formed on the balancer housing 93 such that the outer diameter part 97 of the balancer 90 contacts the inner diameter part 73 of the body 70 and then is screw-connected to the inner diameter part 73 of the body 70. However, the connection between the balancer 90 and the body 70 is not limited thereto and may be connected with one another by any type of connection method.

Second blades 98, as shown in FIG. 5, are provided on the rear surface of the balancer housing 93 opposite to the housing cover 95 forming the front surface of the balancer 90. A plurality of second blades 98 may be arranged in the radial direction from the center of the balancer 90.

The second blades 98 lift the laundry and then drop the laundry during the rotation of the inner tub 30, and thus improve washing force. Further, the second blades 98 generate water current during the rotation of the body 70, and thus add to improvement in washing force.

The housing cover 95 closes the front surface of the balancer housing 93 to form the race 94 within the balancer housing 93. The housing cover 95 is connected to the balancer housing 93 through welding, for example, but may be connected by any type of connection method.

A fastening guide 90*a* to receive a front end 76 of the body 70 is formed in a circular shape at an external part of the housing cover 95 in the radial direction along the circumference of the housing cover 95.

Therefore, as shown in FIG. 5, after the outer diameter part 97 of the balancer 90 contacts the inner diameter part 73 of the body 70 by inserting the front end 76 of the body 70 into the fastening guide 90*a* of the balancer 90, the screw holes 72 of the body 70 are coincided with the screw holes 93*a* of the balancer 90, and then the balancer 90 is connected directly with the inner diameter part 73 of the body 70 by inserting screws into the screw holes 72 and the screw holes 93*a*.

A protrusion 99 protruded forwardly to guide laundry put into and taken out of the body 70 is formed on the housing cover 95.

The protrusion 99 prevents laundry and other foreign substances from being introduced into a gap between the cover 22 of the outer tub 20 and the inner tub 30, and maintains a regular interval between the outer tub 20 and the inner tub 30.

Although this embodiment illustrates that the fastening guide 90*a* and the protrusion 99 are provided on the housing cover 95, the fastening guide 90*a* and the protrusion 99 may be provided on the balancer housing 93, or the fastening guide 90*a* may be provided on one of the housing cover 95 and the balancer housing 93 and the protrusion 99 may be provided on the other one of the housing cover 95 and the balancer housing 93, according to design.

Further, the protrusion 99 and the second blades 98 may be separately formed and then connected to the balancer 90, or may be formed integrally with the balancer 90 through injection molding as in this embodiment.

Although the balancer housing 93 and the housing cover 95 may be injection molded products, the balancer housing 93 and the housing cover 95 may be made of metal according to required strength of the balancer 90 and other designs.

Therefore, the balancer is connected directly to the front surface of the body of the inner tub without the conventional front surface plate connected to the front surface of the body to form the inlet, thereby simplifying a manufacturing process of the inner tub and reducing manufacturing costs of the inner tub.

Further, the balancer is connected to the front surface of the body to form the inlet and to reinforce the front surface of the body made of metal, simultaneously, thereby preventing deformation of the body during driving of the washing machine.

Moreover, the balancer is mounted on the inner diameter part of the body to contact laundry and is provided with the second blades, thereby contacting or lifting the laundry located at the front part of the inner tub and generating a current in wash water to improve washing force. That is, since the balancer is also used to wash the laundry located at the front part of the body, the body has an increased washing capacity compared with the conventional body having the same size.

Hereinafter, a washing machine in accordance with at least one embodiment will be described.

Figure 6:
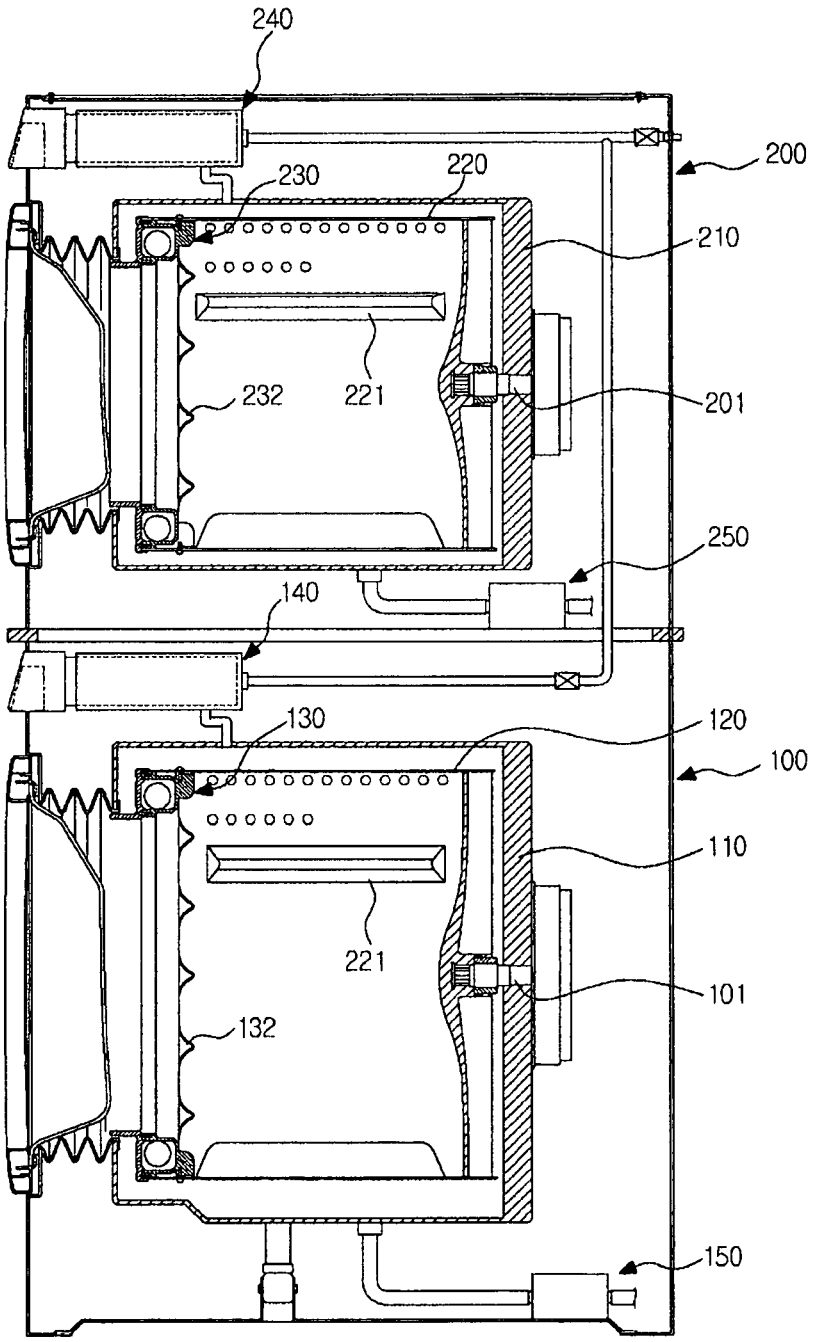
FIG. 6 is a longitudinal-sectional view schematically illustrating a washing machine in accordance with at least one embodiment.

FIG. 6 is a longitudinal-sectional view schematically illustrating a washing machine in accordance with at least one embodiment.

In FIG. 6, the washing machine in accordance with at least one embodiment includes a plurality of washing units (for example, two washing units) vertically arranged to divisionally wash laundry according to amounts or kinds of the laundry. In an embodiment, a first washing unit 100 to wash a large amount (for example, 10 Kg or more) of laundry is installed at the lower part, and a second washing unit 200 to wash a smaller amount of laundry than that of the first washing unit 100 is installed at the upper part. However, either one of the first washing unit 100 or the second washing unit 200 may be able to wash a larger amount of laundry.

Although the first and second washing units 100 and 200 may have the same capacity, if necessary, the first and second washing units 100 and 200 may have different capacities, i.e., a large capacity and a small capacity, in respect of characteristics of the washing machine having the plural washing units 100 and 200. Thereby, if a small amount of laundry is desired to be washed (particularly, in a boiling wash course), only the second washing unit 200 having the small capacity is operated to prevent unnecessary power consumption.

The basic configuration of the first and second washing units 100 and 200 of the washing machine in accordance with at least one embodiment is the same as that of the washing machine in accordance with at least one embodiment shown in FIGS. 1 to 5. Further, first and second cylindrical inner tubs 120 and 220 provided with a plurality of holes (not shown) are rotatably installed in first and second outer tubs 110 and 210 of the first and second washing units 100 and 200, and driving devices to rotate first and second rotary shafts 101 and 201 connected to the first and second inner tubs 120 and 220 to perform washing, rinsing, and spin-drying cycles are respectively installed at the outside of rear surfaces of the first and second outer tubs 110 and 210.

Water supply devices 140 and 240, drain devices 150 and 250, and other structures of the washing machine in accordance with at least one embodiment may be the same as those of the washing machine in accordance with the embodiment shown in FIGS. 1 to 5.

Further, the first and second inner tubs 120 and 220 of the washing machine in accordance with at least one embodiment may be the same as those of the washing machine in accordance with the embodiment shown in FIGS. 1 to 5. Particularly, a balancer 230 is connected directly to a body of the second inner tub 220 having the small capacity without the conventional front surface plate connected to the front surface of the body, and thus the second inner tub 220 may have an increased washing capacity compared with the conventional inner tub having the same size. Further, since the inner tub having the small capacity experiences limited body deformation as compared with the inner tub having the large capacity, required strength of a balancer housing and a housing cover of the second inner tub 220 may be decreased.

Further, the second inner tub 220 having the small capacity has a small dropping height of laundry by first blades 221, and thus may cause deterioration of washing force. However, second blades 232 provided on the balancer 230 makes up for the deterioration of washing force. A balancer 130 may also be connected directly to a body of the first inner tub 120 without the conventional front surface plate, and may include second blades 132, which are in addition to first blades 221 provides at the first inner tub 120.

Although at least one embodiment illustrates the first and second inner tubs as having the same structure as the inner tub in accordance with the embodiment shown in FIGS. 1 to 5, the first inner tub having the large capacity may be configured such that a front surface plate is connected to the front surface of a body of the first inner tub and then a balancer may be installed at an outer diameter part of the front surface plate.

Hereinafter, an assembly method of the inner tub of the washing machine in accordance with at least one embodiment will be described.

Figure 7:
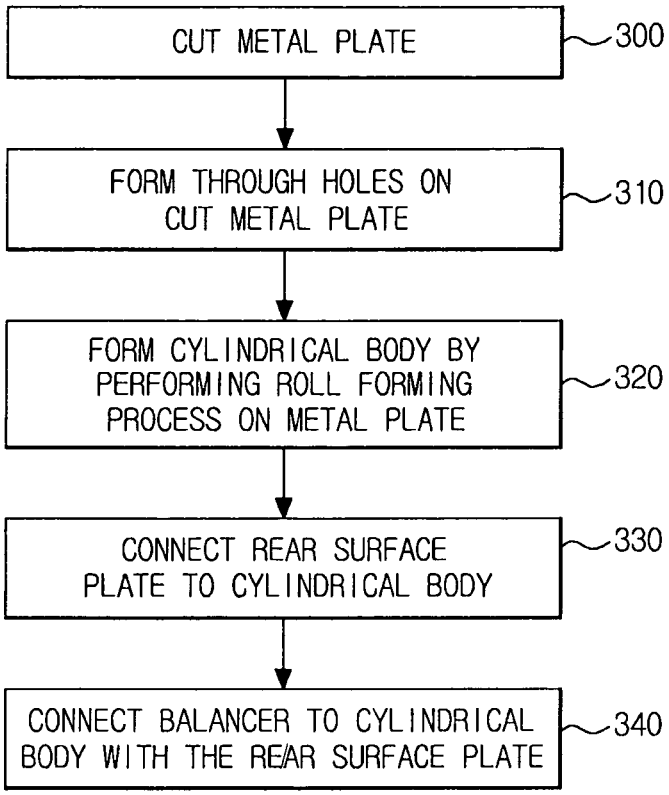
FIG. 7 is a flow chart illustrating an assembly method of the inner tub of the washing machine in accordance with at least one embodiment.

FIG. 7 is a flow chart illustrating the assembly method of the inner tub of the washing machine in accordance with the embodiments of the present invention.

A metal plate is cut to a designated size through a blanking process according to a washing capacity (operation 300), and through holes 71 are formed on the cut metal plate through a piercing process (operation 310). A roll forming process is performed to form a cylindrical body 70 using the metal plate provided with the through holes 71 (operation 320), and the cylindrical body 70 is completed by bending both ends of the cylindrical body 70 contacting each other and then performing seaming and beading processes.

A rear surface plate 80 is connected to the completed cylindrical body 70 through a seaming process (operation 330). A front end 76 of the cylindrical body 70 to which the rear surface plate 80 is connected is inserted into a fastening guide 90*a* of a balancer 90, and then the balancer 90 is connected to an inner diameter part 73 of the body 70 using screws through an outer diameter part 75 of the body 70 (operation 340, with reference to FIG. 4).

Here, the rear surface plate 80 may be connected to the body 70 after the balancer 90 is connected to the body 70, and first blades 74 may be connected to the body 70 at any operation of the assembly process of the inner tub.

As is apparent from the above description, in an inner tub of a washing machine in accordance with at least one embodiment, a balancer is connected directly to the front surface of a body of the inner tub without the conventional front surface plate connected to the front surface of the body to form an inlet, thereby simplifying a manufacturing process of the inner tub and reducing manufacturing costs of the inner tub.

Further, the balancer is connected to the front surface of the body to form an inlet and to reinforce the front surface of the body made of metal, simultaneously, thereby preventing deformation of the body during driving of the washing machine.

Moreover, the balancer is mounted on the inner diameter part of the body to contact laundry and is provided with the second blades, thereby contacting or lifting the laundry located at the front part of the inner tub and generating a current in wash water to improve washing force. That is, since the balancer is also used to wash the laundry located at the front part of the body, the body has a substantially improved washing capacity compared with the conventional body having the same size.

Although at least one embodiment has been shown and described, it would be appreciated by those skilled in the art that changes may be made in these embodiments without departing from the principles and spirit of the invention, the scope of which is defined in the claims and their equivalents.

What is claimed is:

1. A washing machine, comprising:

a housing;

an outer tub provided in the housing to store water, the outer tub including a cylindrical part provided with an inlet formed at one surface thereof;

an inner tub formed in a cylindrical shape provided with an opening at one surface thereof, and provided in the outer tub;

a balancer connected to an inner diameter part of the inner tub at the opening of the inner tub to reduce unbalance of the inner tub generated during rotation of the inner tub and to reinforce the inner tub; and a bellows to close a designated front region of the outer tub between the housing and the outer tub, a portion of the bellows extending into the inlet of the outer tub; and a protrusion extending from the balancer and toward the bellows to guide the laundry into and out of the inner tub, wherein the protrusion overlaps the portion of the bellows extending into the inlet of the outer tub to close a gap between the bellows and the inner tub, and to maintain a regular interval between the outer tub and the inner tub.

2. The washing machine according to claim 1, wherein the balancer is mounted to contact laundry in the inner tub.

3. The washing machine according to claim 1, wherein a designated region of the inner tub at the opening has a diameter which is regular in the axial direction of the inner tub.

4. The washing machine according to claim 1, wherein the balancer includes an inner diameter part forming an inlet through which laundry is put into the inner tub, and an outer diameter part contacting the inner diameter part of the inner tub.

5. The washing machine according to claim 4, wherein a fastening guide into which a front end of the inner tub at the opening is inserted is provided on the outer diameter part of the balancer.

6. The washing machine according to claim 1, wherein the balancer further includes at least one blade extending from a surface of the balancer facing toward an inside of the inner tub, the at least one blade generating a water current during the rotation of the inner tub.

7. The washing machine according to claim 6, wherein the at least one blade is provided in plural number and formed in the radial direction from the center of the balancer.

8. The washing machine according to claim 1, wherein the balancer is a ball balancer including a plurality of balls and a fluid provided therein.

9. The washing machine according to claim 1, further comprising:

at least one first blade provided on the inner diameter part of the inner tub; and at least one second blade provided on the balancer.

10. The washing machine according to claim 1, further comprising a pair of washing units vertically stacked, wherein the balancer is provided on at least one of the washing units.

11. The washing machine according to claim 1, wherein the inner tub includes a first plurality of screw holes defined therethrough, and the balancer includes a second plurality of screw holes defined therethrough corresponding to the first screw holes, the balancer being screw-connected to the inner tub by the first and second screw holes.

* * * * *